US007318591B2

(12) United States Patent
Landry

(10) Patent No.: US 7,318,591 B2
(45) Date of Patent: Jan. 15, 2008

(54) BLADE RUNNER ASSEMBLY FOR SKATEBOARD

(76) Inventor: Sylvain Landry, 325 Bergevin, #3, LaSalle, QBC (CA) H8R 3M4

( * ) Notice: Subject to any disclaimer, the term of this patent is extended or adjusted under 35 U.S.C. 154(b) by 128 days.

(21) Appl. No.: 11/059,677

(22) Filed: Feb. 17, 2005

(65) Prior Publication Data

US 2005/0212226 A1 Sep. 29, 2005

Related U.S. Application Data

(60) Provisional application No. 60/544,301, filed on Feb. 17, 2004.

(51) Int. Cl.
*A63C 17/18* (2006.01)

(52) U.S. Cl. ..... 280/14.21; 280/14.26; 280/87.042

(58) Field of Classification Search ..... 280/7.12, 280/7.13, 7.14, 10, 14.21, 14.25, 14.26, 87.041, 280/87.042
See application file for complete search history.

(56) References Cited

U.S. PATENT DOCUMENTS 1,123,686 A * 1/1915 Cole et al. ..... 280/87.042
1,389,418 A * 8/1921 Arner ..... 280/7.14
3,203,706 A * 8/1965 Boyden ..... 280/7.12
4,114,913 A 9/1978 Newell et al.
4,116,455 A * 9/1978 Dotson et al. ..... 280/7.12
4,161,323 A * 7/1979 Wetteland ..... 280/7.12
4,165,091 A 8/1979 Chadwick
4,194,753 A 3/1980 Schrishuhn, Jr.
4,225,145 A 9/1980 Carr
4,521,029 A 6/1985 Mayes
4,896,893 A 1/1990 Shumays et al.
5,161,810 A 11/1992 DeCesare
5,984,328 A * 11/1999 Tipton ..... 280/87.042
6,311,990 B1 11/2001 Landry
6,616,155 B2 * 9/2003 Tuan ..... 280/87.041
6,648,348 B2 * 11/2003 Link ..... 280/14.25
6,811,165 B2 * 11/2004 Chang ..... 280/87.041

* cited by examiner

*Primary Examiner*—Christopher Bottorff
(74) *Attorney, Agent, or Firm*—Equinox Protection; Franz Bonsang, Patent Agent

(57) ABSTRACT

A runner assembly housing a blade for an ice skateboard and rotatably connected to a truck assembly mounted to a bottom board surface thereof has an elastic biasing cord connecting a an elongate body housing a blade to the truck assembly or the skateboard for biasing the body towards a neutral position in which the blade is substantially parallel to the bottom board surface of the ice skateboard and faces away therefrom. The runner assembly has through openings defining body channels on opposing body ends of the body and through which the biasing cord extends when connected to the body ends, the biasing cord having protrusions for holding the biasing cord in the body channels. The biasing cords are releasably snappably connectable to the body ends by snappingly introducing the biasing cord into the body channels through open neck sections extending into the body channels.

18 Claims, 8 Drawing Sheets

BLADE RUNNER ASSEMBLY FOR SKATEBOARD

CROSS REFERENCE TO RELATED APPLICATION

This application is related to U.S. provisional application for patent Ser. No. 60/544,301 filed on Feb. 17, 2004.

FIELD OF THE INVENTION

The present invention relates generally to ice skateboards having ice blades, and more particularly to a skateboard runner assembly housing the blades and having biasing means for biasing their position.

BACKGROUND OF THE INVENTION

Ice skateboards having ice blades are well known in the prior art. On such skateboards, the ice blades typically are either directly attached to the board of the skateboard or mounted on the truck axles of the truck assembly of the skateboard in replacement of the roller wheels.

For such ice skateboards, free rotation of the blades, or blade runner assembly housing the blades, may be desirable to allow, among other things, the blade to swing freely and maintain the blade oriented downwardly towards the ground when the skateboard is raised or held above the ground. This downward orientation is especially useful should a user fall and the surface of the skateboard upon which the blades are connected be turned upwardly facing away from the ground. In such a situation, the blades turn inwardly towards the board for reducing risk of injury should the user fall on the skateboard. Such a feature may be particularly advantageous for novice users.

Maintaining completely free rotation of the runner assembly around an axis may nevertheless render the board unstable when sliding on an ice surface as the runner may rotate due to force applied thereupon and not engage the ice surface correctly. Thus, some users may desire that the free rotation of the blade be limited or restrained. One manner for achieving restraint or limitation of a runner assembly is use of a position stabilizing means, such as a biasing means which biases runner assembly, more specifically the body thereof, body toward a neutral position in which the blade is substantially parallel to the bottom board surface to which the runner assembly is connected and faces generally oppositely away therefrom. For users that do not wish to have such restrictions the biasing means may be selectively disconnected from the board of the skateboard or the body of the runner assembly for disengaging the biasing means.

Examples of ice skateboards, including skateboards having freely rotatable runner assemblies for the blades with position stabilizing means, such as biasing means, are disclosed in the following documents:

- U.S. Pat. No. 6,311,990 issued on Nov. 6, 2001 to Sylvain Landry;
- U.S. Pat. No. 4,114,913 issued on Sep. 19, 1978 to W. K. Newell et al.;
- U.S. Pat. No. 4,165,091 issued on Aug. 21, 1979 to D. E. Chadwick;
- U.S. Pat. No. 4,194,753 issued on Mar. 25, 1980 to D. Schrishuhn, Jr.;
- U.S. Pat. No. 4,225,145 issued on Sep. 30, 1980 to R. K. Carr;
- U.S. Pat. No. 4,521,029 issued on Jun. 4, 1985 to T. L. Mayes;

- U.S. Pat. No. 4,896,893 issued on Jan. 30, 1990 to A. A. Shumays et al.; and
- U.S. Pat. No. 5,161,810 issued on Nov. 10, 1992 to J. J. DeCesare.

However, while some of these skateboards or runner assemblies have features such as biasing means that bias the blades or blade runners in the neutral position, they suffer from a number of drawbacks. For example, runner assemblies using such biasing means, and the biasing means themselves, are often difficult to install and cannot be easily retrofitted on existing skateboards. Further, such runner assemblies and biasing means may be mechanically complicated and fragile, especially when placed under extreme usage conditions or subjected to complex acrobatic maneuvers. The biasing means may be particularly susceptible to wear and tear during such maneuvers and when a non-blade portion of the runner assembly body, to which the biasing means may be connected, slides across a sliding surface, ice or otherwise.

Accordingly, there is a need for an improved blade runner assembly for an ice skateboard that has a biasing means that is easily and selectively connectable thereto and to the skateboard and which reduces wear on the biasing means.

SUMMARY OF THE INVENTION

In a first aspect of the present invention, therein is provided an ice skateboard runner assembly for housing a blade of an ice skateboard, the skateboard having a board with a top board surface and a bottom board surface and a truck assembly mounted on the bottom board surface, the runner assembly comprises: an elongate body having generally opposed first and second longitudinal body ends, the body longitudinally housing the blade and being rotatably connectable to the truck assembly at a mounting position intermediate the first and the second body ends and being positionable in a runner neutral position in which the blade is substantially parallel to the board and faces generally away therefrom; and at least one elastic biasing cord releasably connecting the skateboard to the body ends, for elastically biasing the body toward the neutral position when one of the first body end and the second body end is moved away from the board; wherein each body end has a respective open neck section extending proximally therefrom respectively into a respective body channel therefore defined by a respective through opening extending through the body proximal the body end and each biasing cord has a body connecting means protrusion situated on a first cord end thereof, the respective open neck and the biasing cord being configured for selectively and removably snappably inserting the biasing cord through the respective open neck into the respective body channel to releasably connect the biasing cord to the body end, the body connecting means protrusion being sized and shaped to prevent passage thereof through the respective body channel.

Advantageously, the runner assembly, using biasing means, stabilizes the blade. In addition, biasing means is easily attached to running assembly. Further, the body is shaped to reduce wear on biasing means.

Runner assembly is further advantageous in that it provides runner surfaces upon which body of runner may slide on a sliding surface even when the body is not in the neutral position.

BRIEF DESCRIPTION OF THE DRAWINGS

Further aspects and advantages of the present invention will become better understood with reference to the description in association with the following Figures, wherein.

DETAILED DESCRIPTION OF THE PREFERRED EMBODIMENTS

Figure 1:
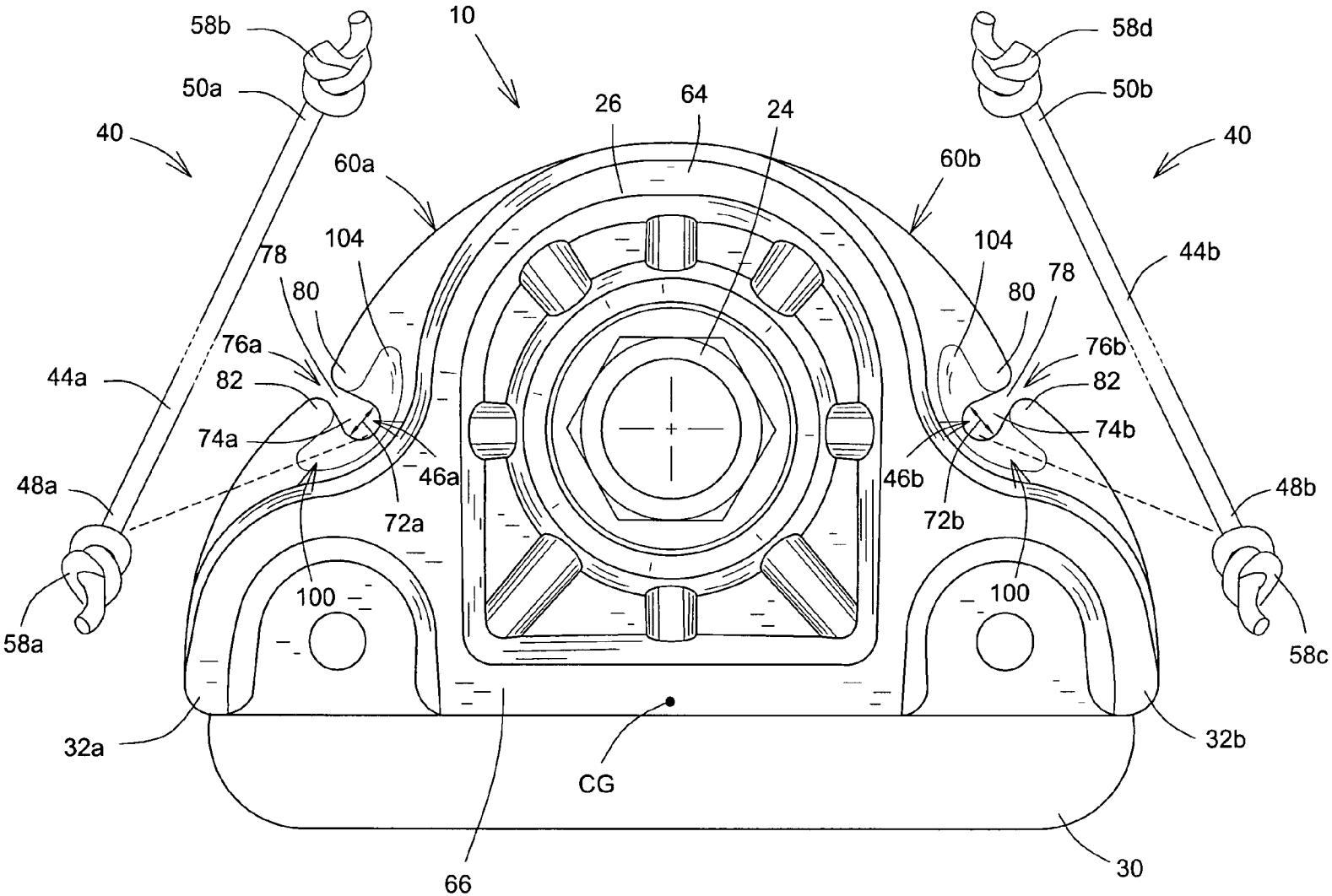
FIG. 1 is an exploded front elevational view of an ice skateboard runner assembly in accordance with a first embodiment of the present invention.

With reference to the annexed drawings the preferred embodiments of the present invention will be herein described for indicative purpose and by no means as of limitation.

Referring to FIGS. 1 through 5, there is shown ice skateboard blade runner assembly, shown generally as 10, for use with a skateboard 12 on an ice sliding surface "S" or the like. Typically, runner assembly 10, or runner, is rotatably connectable, i.e. mountable, on conventional truck axles 14 of trucks assembly 16. Truck assembly 16 is, in turn, mounted on bottom board surface 18 of board 20 of ice skateboard 12, with bottom board surface 18 being generally opposite top board surface 22 of board 20 upon which a user, not shown, of the skateboard 12 typically stands.

As runner 10 is mounted on the truck axles 14, it replaces the conventional roller wheels (not shown) and is mounted in the same manner as the roller wheels. Specifically, runner 10 has bearing assembly 24, as do conventional roller wheels, mounted inside body 26 and which is adapted for rotatably connecting to truck axle 14 of skateboard truck assembly 16 in a manner which is similar to the mounting of a conventional skateboard roller wheel (not shown). Thus, body 26 is rotatably connectable to truck assembly 16.

Body 26 houses blade 30 and has generally opposed first longitudinal body end 32*a* and second longitudinal body end 32*b*, between which blade 30 is housed in blade housing 66 and extends downwardly therefrom. Body 26 is rotatably connected, i.e. mounted, on truck axle 14 at a position intermediate first body end 32*a* and second body end 32*b*. In all other aspects, rotatable connecting of body 26, and specifically bearing assembly 24, on truck axles 14 is similar to mounting typical skateboard roller wheels having wheel bearing assemblies on truck axle 14. Typically, there is one runner 10 to replace each roller wheel and each blade 30 is housed in a runner 10. Since roller wheels, bearing assemblies 24, truck axles 14, and connecting techniques therefor are well known in the art, further details of mounting runner 10, and more specifically body 26 thereof, on truck axle 14 are unnecessary.

Referring still to FIGS. 1, 2, 3, 5, 9 and 10, runner 10 has biasing means, shown generally as 40, connected to body 26 on at least first body end 32*a* and also connected to at least a first skateboard connecting means which in the embodiment is a board channel 106 on board 12 or truck cavity 114 in truck assembly 116. Biasing means 40 includes at least one elastic biasing member which, in the embodiment, is at least one elastic cord 44. Biasing means 40, i.e. elastic cords 44, is attached to body connecting means, shown generally as 46, on each body end 32. More specifically, as shown, biasing means 40 comprises first elastic cord 44*a* and second elastic cord 44*b*, each having longitudinal cord first ends 48 and generally opposed longitudinal cord second ends 50. In other words, first elastic cord 44*a* has longitudinal first cord first end 48*a* and generally opposed longitudinal first cord second end 50*a*, whereas second elastic cord 44*b* has longitudinal second cord first end 48*b* and generally opposed longitudinal second cord second end 50*b*.

Figure 10:
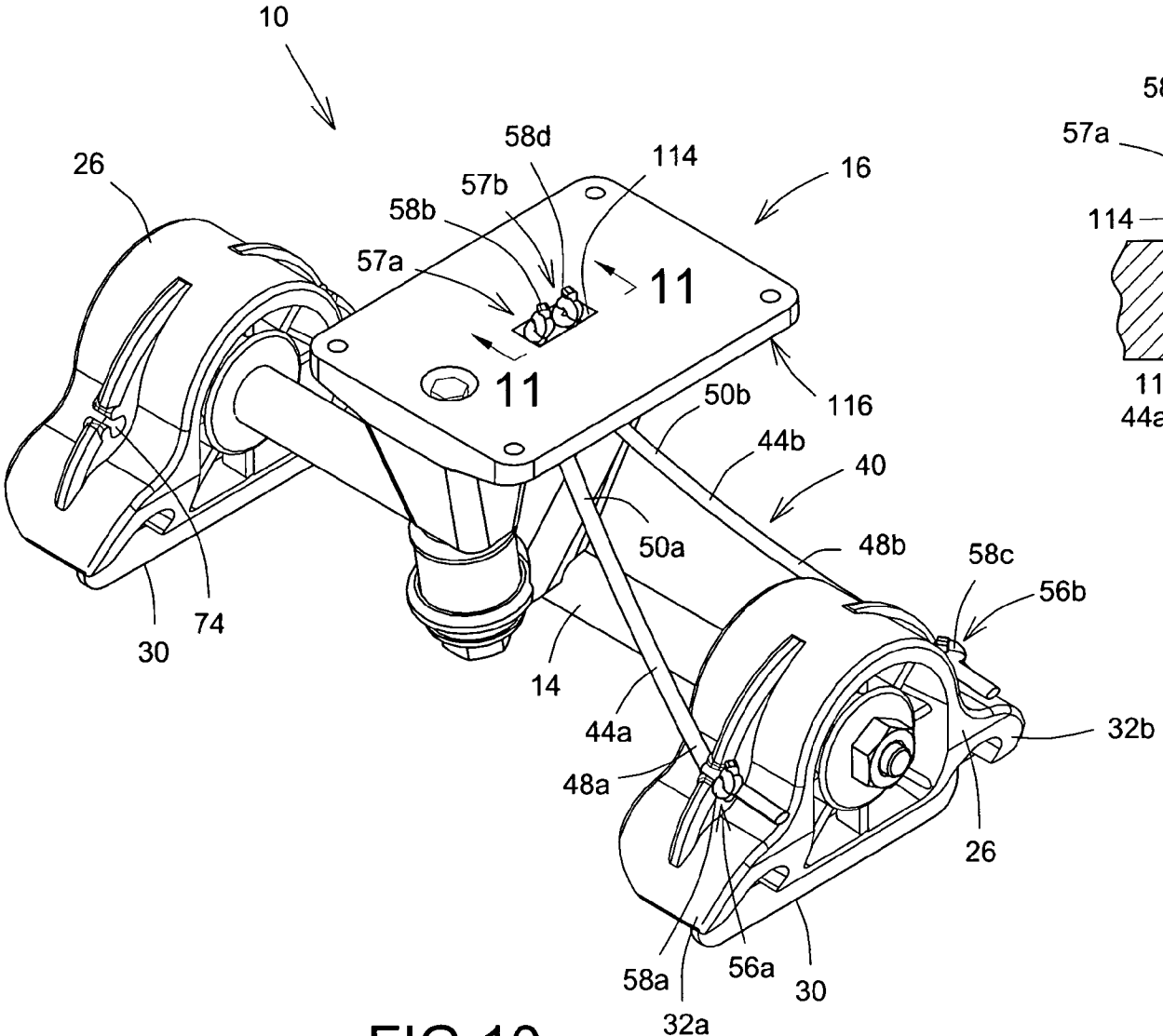
FIG. 10 is a top perspective view of a truck assembly with runner assembly of FIG. 1 connected thereto.

In the embodiment, elastic cord second ends 50 are selectively releasably connected to at least one skateboard connecting means, i.e. at least a first, board channel 106 shown in FIG. 1 or a truck cavity 114 shown in FIG. 10, on skateboard 12. Elastic cord first ends 48 are removably connected to body connecting means 46 on first body end 32*a* and second body end 32*b*. More specifically, first cord first end 48*a* is connected to first body connecting means 46*a* on first body end 32*a* and second cord first end 48*b* is connected to second body connecting means 46*b* on second body end 32*b*.

As more specifically shown in FIGS. 2, 5, 6, 9, and 10 when connected to body 26 using body connecting means 46, biasing means 40, i.e. elastic cords 44, biases body 46 toward neutral position, shown generally as 54, in which blade 30 is substantially parallel to bottom board surface 18 and faces generally oppositely away therefrom. More specifically, when first body first body end 32*a* is moved away from bottom board surface 18 and is connected on first body connecting means 46*a* to biasing means 40, i.e. first elastic cord 44*a*, which is in turn connected on first cord second end 50*a* to board channel 106, first elastic cord 44*a* is stretched into a stretched configuration, shown generally as 55. Moving first body end 32*a* away from neutral position 54 and away from bottom board surface 18 thus generates a biasing force as first elastic cord 44*a* is stretched into stretched configuration 55. The biasing force is applied by biasing means 40, i.e. first elastic cord 44*a*, to first body end 32*a* as first elastic cord 44*a* retracts back into retracted position and returns body 26 to neutral position 54. Second elastic cord 44*b* of biasing means 40, when connected on second cord second end 50*b* to skateboard connecting means, board channel 106 or truck cavity 114, and to second body connecting means 46*b*, biases second body end 32*b* when moved away from board 20 in exactly the same way as the first elastic cord 44*a* for the first body end 32*a*.

Referring now to FIGS. 1 2, 3, 4, 9, and 10, biasing means 40, i.e. elastic cords 44, has body connecting means protrusions, shown generally as 56, which are selectively removably connectable to body connecting means 46 for connecting biasing means 40 to body ends 32. Skateboard connecting means protrusions, shown generally as 57, are selectively releasably connectable to skateboard connecting means, i.e. board channel 106, to selectively removably connect biasing means 40 thereto. Body connecting means protrusions 56 and skate board connecting means protrusions 57 are connecting knots 58, and are sized to be of greater dimension, i.e. greater size, than though openings 72 in body connecting means 46 and skateboard connecting means openings 110, 118 of skateboard connecting means 106. 114 through which elastic cords 44 extend. Thus, body connecting means protrusions 56 and skate board connecting means protrusions 57 prevent integral withdrawing of biasing means 40, i.e. elastic cords 44. Connecting knots 58 are tied in their respective locations on elastic cords 44 for selectively forming the connecting knots 58 and, thereby, body connecting means protrusions 56 and skateboard connecting means protrusions 57. Similarly, connecting knots 58 may be selectively removed by untying thereof, thus allowing selective removal of body connecting means protrusions 56 and skateboard connecting means protrusions 57. Therefore, elastic cords 44, and thereby biasing means 40, are easily and selectively removable. Since skateboard connecting means 106, 114 has openings 110, 118 of smaller size than the desired size of skateboard connecting means protrusions 57, connecting knots 58 serving as skateboard connecting means protrusions 57 typically are formed after elastic cords 44 have been extended therethrough. Similarly, elastic cords 44, and therefore biasing means 40, when connected to body connecting means 46 typically cannot be withdrawn from skateboard connecting means, whether board channel 106 or truck cavity 114, until skateboard connecting means protrusions 57, i.e. connecting knots 58, are removed.

As more specifically shown in FIGS. 1, 2, 4, and 9, first elastic cord 44*a* has first connecting knot 58*a* and second connecting knot 58*b* respectively formed on first cord first end 48*a* and first cord second end 50*a*. Second elastic cord 44*b* has third connecting knot 58*c* and fourth connecting knot 58*d* formed respectively on second cord first end 48*b* and second cord second end 50*b*. First connecting knot 58*a* and third connecting knot 58*c* are used, respectively, as first body connecting means protrusion 56*a* and second body connecting means protrusion 56*b*, which are respectively connectable to first body connecting means 46*a* and second body connecting means 46*b*. Second connecting knot 58*b* and fourth connecting knot 58*d* are, respectively, first skateboard connecting means protrusion 57*a* and second skateboard connecting means protrusion 57*b* and connect biasing means to skateboard connecting means, i.e. board channel 106.

As more specifically shown in FIGS. 1, 3, 5, and 6, first body end 32*a* and second body end 32*b* each have a generally convex semicircular runner surface 60 extending downwardly from top portion 64 of runner 10, generally opposite blade 30, to blade housing 66 situated intermediate first body end 32*a* and second body end 32*b*. Specifically, first body end has first runner surface 60*a* and second body end 32*b* has second runner surface 60*b*. Each runner surface 60*a*, 60*b* is substantially smooth and allows body 26 to slide smoothly thereupon on a sliding surface S when, respectively, first body end 32*a* and second body end 32*b* are moved away from bottom board surface 18. Thus a user may slide on sliding surface S, even when body 26 of skateboard 12 is not situated on ice, on first runner surface 60*a* or second runner surface 60*b* when body 10 is displaced from neutral position 54.

First runner surface 60*a* and second runner surface 60*b* are substantially symmetrical and smoothly aligned one with the other to form a substantially continuous surface. In addition, mounting position 68, intermediate first body end 32*a* and second body end 32*b* and where bearing assembly 24 is mounted on truck axle 14, is situated at substantially equal distances between first body end 32*a* and second body end 32*b*, and is therefore substantially centered therebetween. Mounting position 68 is also substantially centered between top portion 64 and blade 30. Further, body 26 is spaced below bottom blade surface 18 such that there is sufficient space for body 26 to effect a complete rotation upon truck axle 14 under bottom board surface 18 when rotatingly connected to truck axle 14 and biasing means 40 is disconnected from first body end 32*a* and second body end 32*b* or disconnected from skateboard connecting means, whether board channel 106 or truck cavity 114.

The center of gravity "CG" of the body 26 is situated in proximity of blade 30, such that the blade 30 will face downwardly towards the ground when the skateboard 12 is raised or held above sliding surface S. In particular, for users wishing to maximize safety, blade 30 will turn towards bottom board surface 18 when skateboard 12 is overturned, provided body 26 is not attached to biasing means 40. Thus, the runner 10 allows users to selectively maintain free rotation of body 10, by disconnecting biasing means 40 from first body end 32*a* and second body end 32*b*, or to restrict the degree of rotation thereof with biasing means 40 by connecting biasing means 40 to first body end 32*a* and second body end 32*b*, respectively using first body connecting means 46*a* and second body connecting means 46*b*. Finally, users may choose to connect biasing means 40 to only one of only one of first body end 32*a* and second body end 32*b*, thus choosing a compromise between full restriction of rotation of body 26 with biasing means 40 connected to first body end 32*a* and second body end 32*b* and full rotation with biasing means 40 disconnected from both first body end 32*a* and second body end 32*b*.

It will be apparent to one skilled in the art that it is possible that only one of first body end 32*a* and second body end 32*b* have smooth runner surface 60. In addition, first runner surface 60*a* and second runner surface 60*b* need not be smoothly aligned with one another or symmetrical. Finally, it is not essential that mounting position 68 be centrally situated with the center of gravity as described above. It is not the intention of the inventor to limit the scope of the invention to the quantity and configuration of smooth runner surfaces 60 or to placement of the mounting position 68 shown and described herein.

Figure 2:
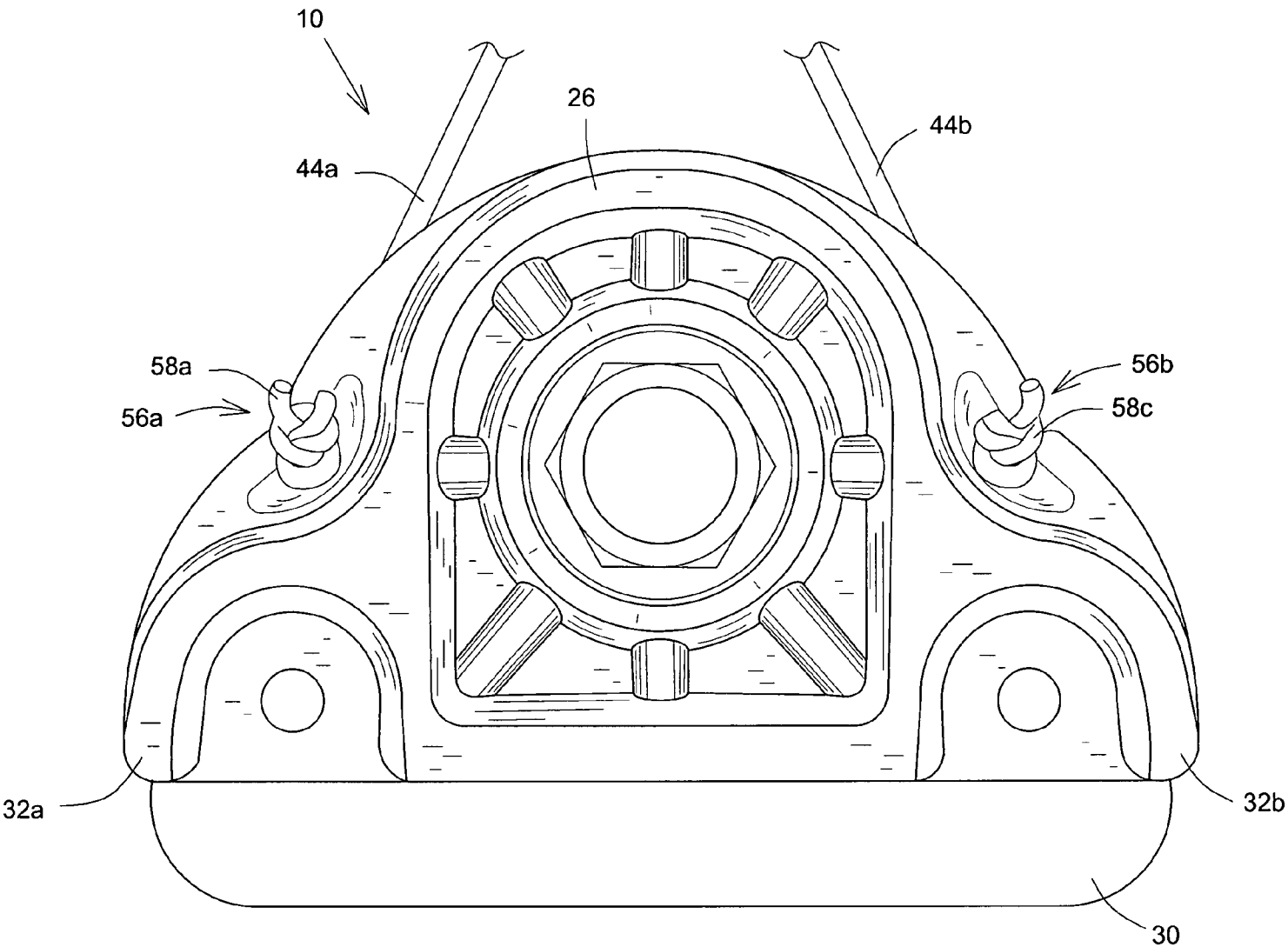
FIG. 2 is a front elevational view of the runner assembly of FIG. 1, showing biasing means attached thereto.
Figure 3:
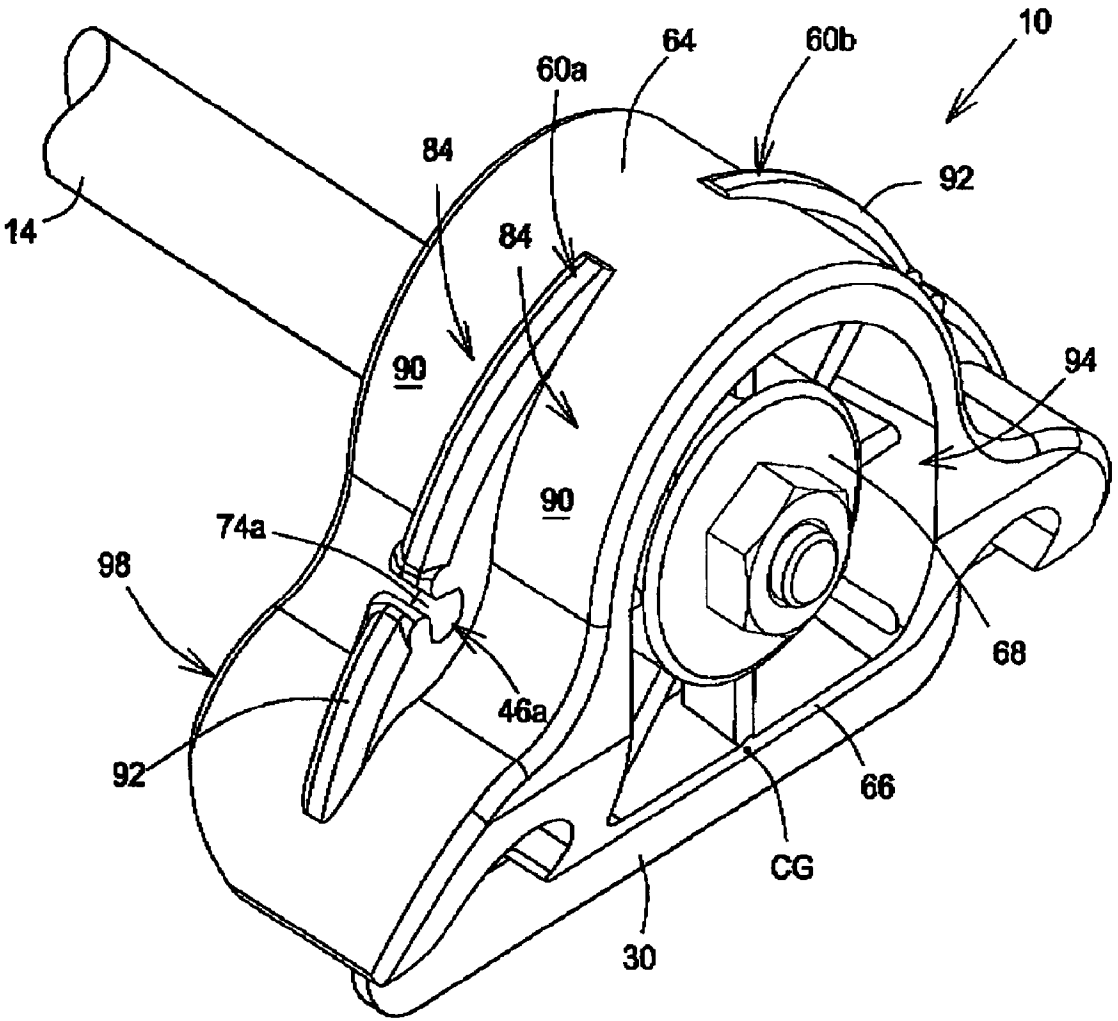
FIG. 3 is a top perspective view of the runner assembly of FIG. 1.

Referring now to FIGS. 1, 2, and 3, first body connecting means 46*a* and second body connecting means 46*b* have respectively transversal through openings 72*a*, 72*b* extending respectively through first body end 32*a* and second body end 32*b* and respectively forming first and second body channels 74*a*, 74*b* extending therethrough. For first body end 32*a*, first biasing member first end 48*a* of first elastic cord 44*a* is disposed in first body channel 74*a*. Body connecting means protrusions 56, i.e. knots 58, are of greater size than through opening 72. Thus, body connecting means protrusions 56 cannot pass therethrough and prevent biasing means 40, i.e. elastic cords 44, from being integrally withdrawn through body channels 74 and being disconnected from body ends 32, provided that each elastic cord 44 is also connected to skateboard connecting means, i.e. board channel 106, or to opposing body connecting means 46.

To facilitate introduction of biasing means 40, i.e. elastic cord 44, into body connecting means 46, i.e. through openings 72 and body channels 74, body ends 32 have open neck sections, shown generally as 76, with neck openings 78. First and second open neck sections 76*a*, 76*b* each have neck opening 78 which extend respectively from first and second runner surfaces 60*a*, 60*b* through respective body ends 32*a*, 32*b* to respective body channels 74*a*, 74*b*. Open neck sections 76 and neck openings 78 are sized and shaped for snappingly introducing biasing means 40, i.e. elastic cords 44, into body channels 74 for secure connecting to body ends 32. Further, elastic cords 44 may be disconnected from body ends 32 by snappingly removing elastic cords through neck openings 78 of neck sections 76. Thus, open neck sections 76, along with through openings 72 and body channels 74, enhance easy and uncomplicated selectively removable connecting of biasing means 40, i.e. elastic cords 44, to body ends 32. Further, since biasing means 40, i.e. elastic cord 44, can be inserted and be removed through open neck section 76, connecting knots 58 serving as body connecting means protrusions 56 may be formed before or after elastic cords 44 are connected to body connecting means 46 and elastic cords 44 may be removed from body connecting means 46 without untying of connecting knots.

Neck openings 78 are defined on runner surfaces 60 by first outer neck ends 80 and generally opposed second outer neck ends 82 disposed on runner surfaces 60. First outer neck ends 80 and second outer neck ends 82, are curved inwardly towards body channels 74 and away from runner surfaces 60, so as not to cause protrusions extending outwardly on runner surfaces 60. Thus, neck openings 78, and therefore neck sections 76, are shaped to maintain a smooth alignment with runner surfaces 60 to ensure that, despite the openings in runner surfaces 60 created by neck openings 78, runner surfaces remain essentially smooth and that runner surfaces 60 can slide on sliding surface S.

As more specifically shown in FIGS. 1, 3, 5, and 6, to reduce wear on biasing means 40, namely elastic cords 44, and to provide guides therefore, runner ends 32 have inlet sections, shown generally as 84. Inlet sections 84 are formed by wall 92, upon which runner surface 60 extends transversely, and by Inner surface 90. Specifically, inner surface 90 extends transversely across body end 32, and wall 92, substantially centrally transversely inset on runner end 32, protrudes outwardly from inner surface 90. Thus, wall 92 and inner surface 90 define inlet section 84 which extends longitudinally inwardly from runner surface 60. Biasing means 40, i.e. elastic cord 44, is at least partially engaged in inlet section 84 when runner surface 60 is sliding upon said sliding surface S, thereby reducing exposure of biasing means 40 to sliding surface S, thereby reducing friction and wear on biasing means 40. In addition, inner surface 90 and wall 92, which biasing means 40, i.e. elastic cords 44, may contact are substantially smooth, which further reduces friction and wear on biasing means 40, i.e. elastic cords 44 and facilitates sliding of runner surface 60 on sliding surface S.

Inlet section 84 also substantially integrally seats biasing means 40 and body connecting means protrusions 56, such as connecting knots 58, therein. Consequently, protrusion of biasing means 40, and body connecting means protrusions 56 thereof, beyond an outer face 94 of body 26 that faces outwardly away from truck assembly 16 is reduced. Thus, engagement by biasing means 40 with foreign objects, not shown, in proximity to outer face 94 is impeded. Outer face 94 is opposite inner face 98 which faces inwardly toward truck assembly 16 when body 26 is connected thereto. Inner face 98, as shown, has essentially all of the features shown for outer face 94.

Each wall 92, and therefore inlet section 84, has outwardly flaring section recess 100, shown generally as 100, disposed therein. Outwardly flaring section recess 100 extends transversely outwardly from body connecting means 46, i.e. through opening 72 and body channel 74, on wall 92. Outwardly flaring section recess 100 is shaped in the form of a boomerang having two smooth guiding grooves 104 extending angularly outwardly from body connecting means 46. Body connecting means protrusions 56 and elastic cords 44 can follow the rotational movement of body 26 on truck axis 14 in guiding grooves 104, thus reducing friction and obstruction of elastic cords 44 when following the rotational movement.

While inlet sections 84 and opening neck sections 76, will generally be present, it will be apparent to one skilled in the art that they will not be necessary on second connecting end 32*b* if second body connecting means 46*b* is not present. It is not the intention of the inventors to limit the scope of the present invention to a body 26 having first and second inlet sections 84 or first and second opening neck sections 76*a*, 76*b* as shown.

Referring now to FIGS. 1, 2, 4, and 9, first elastic cord second end 50*a* and second elastic cord second end 50*b* are connected to first skateboard connecting means, which comprises at least a first board channel 106 extending from bottom surface opening 108 in bottom board surface 16 through board 20 to board channel skateboard connecting means opening 110 in board top board surface 22. Alternatively, and as will be later described in detail for FIG. 10, skateboard connecting means may be truck cavity 114 with truck skateboard connecting means opening 118. Board channel 106 may be formed in board 20 during fabrication thereof or subsequently formed by a user or another person. To connect elastic cords 44*a*, 44*b* to skateboard 10 through first board channel 106*a*, first elastic cord second end 50*a* and second elastic cord second end 50*b* are passed initially through bottom board surface opening 108, through first board channel 106, and then up through first board channel skateboard connecting means opening 110. First skateboard connecting means protrusion 57*a* and second skateboard connecting means protrusion 57*b* are then formed from, respectively, second connecting knot 58*b* and fourth connecting knot 58*d* by tying thereof. As mentioned previously, first and second skateboard connecting means protrusions 57*a*, 57*b*, respectively, second connecting knot 58*b* and fourth connecting knot 58*d*, are of greater dimension than board channel skateboard connecting means opening 110 and may not pass therethrough. Elastic cords 44 cannot therefor be integrally withdrawn through first board channel 106 towards truck assembly 116 through board channel skateboard connecting means opening 110. Thus, provided elastic cords 44*a*, 44*b* are attached, respectively, to body connecting means 46*a*, 46*b*, elastic cords 44*a*, 44*b* are securely connected to skateboard 12.

Figure 4:
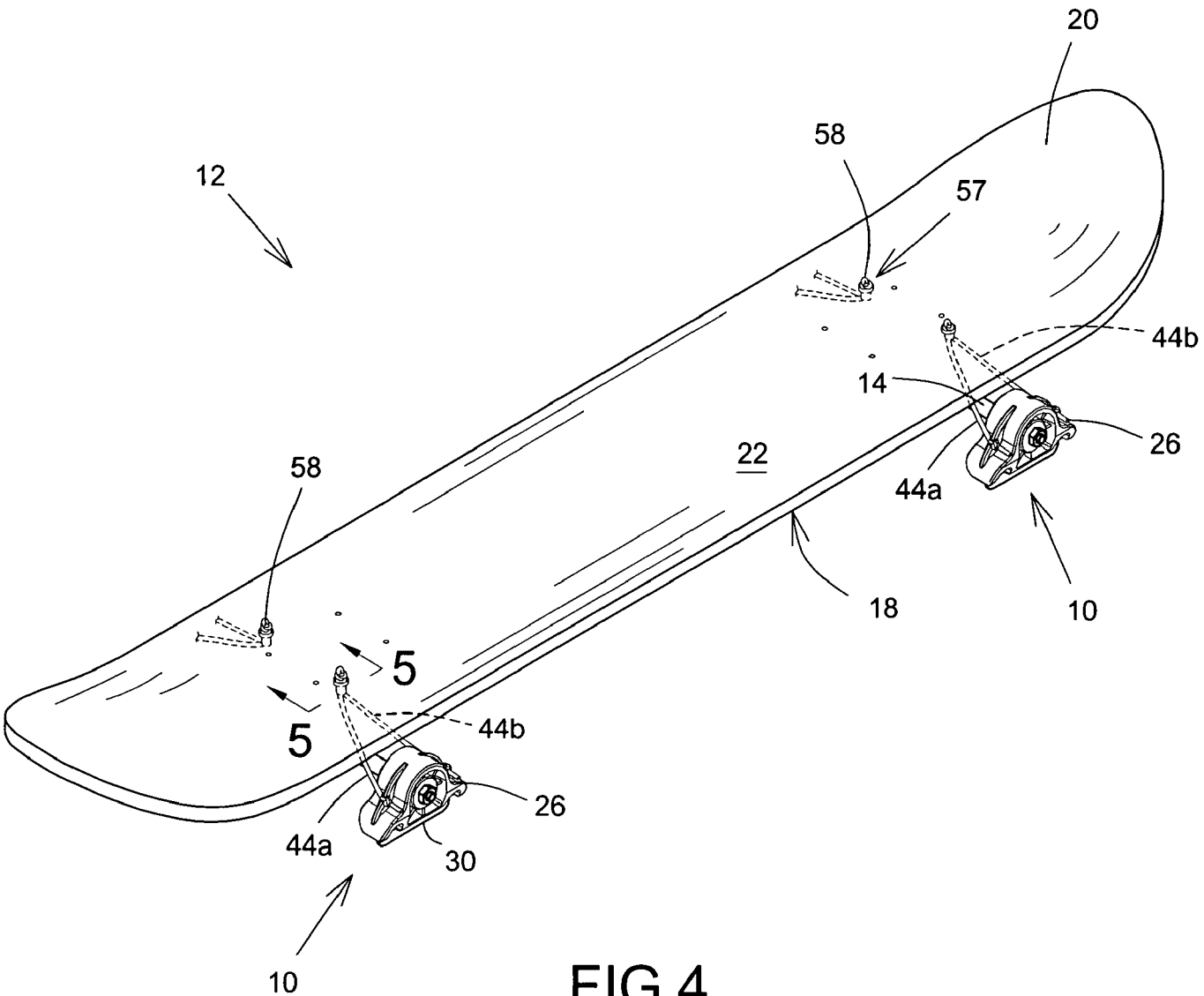
FIG. 4 is a top perspective view of the runner assembly of FIG. 1 mounted to a skateboard with biasing means connected to board channels of the skateboard.
Figure 5:
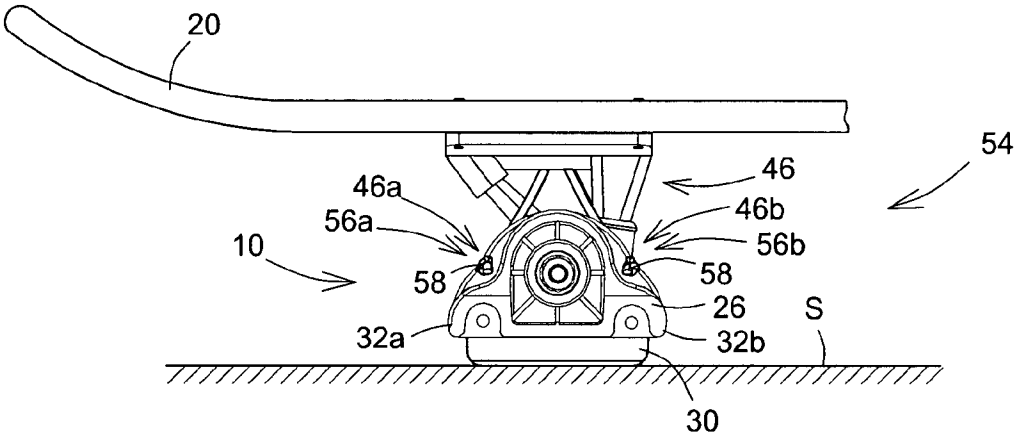
FIG. 5 is a sectional view of the runner assembly mounted to the skateboard, as shown in FIG. 4, with runner assembly in a neutral position.
Figure 6:
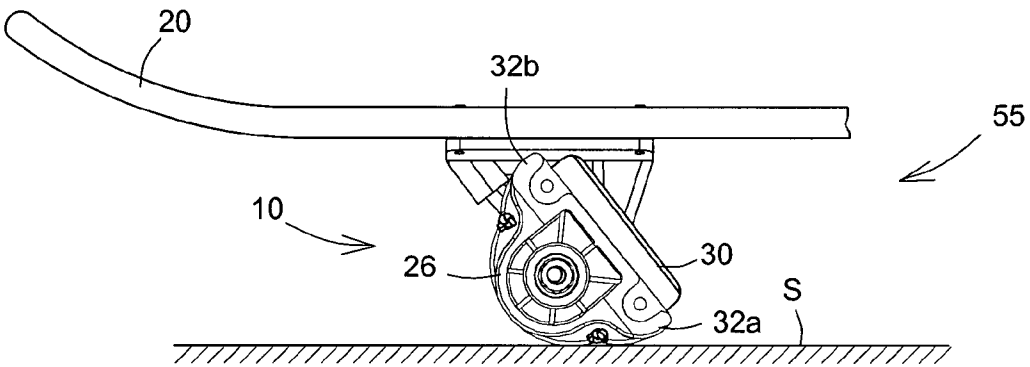
FIG. 6 is a sectional view of the runner assembly mounted to the skateboard, as shown in FIG. 4, with runner assembly moved away from a neutral position.
Figure 9:
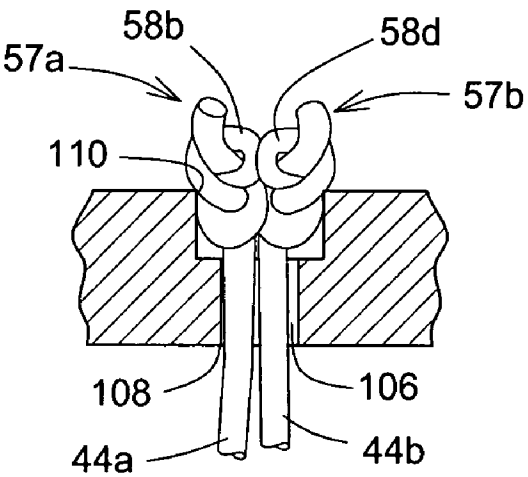
FIG. 9 is a sectional view similar to FIG. 7, showing two elastic cords each cord having a connecting knot.

Referring now to FIGS. 2, 4, and 9, it should be noted that board 20 of skateboard 12 may, optionally, have a second board channel, identical to first board channel 106 shown in FIGS. 4, and 9. In such a case, first elastic cord 44*a* is connected to first body attachment means 46*a* and first board channel 106 exactly as previously described. Similarly, second cord first end 48*b* is also connected to second body connecting means 48*b* as previously described. However, second elastic cord second end 50*b*, forming skateboard connecting means protrusion 57*b*, is connected to second board channel 106 instead of first board channel. Skateboard connecting means protrusions 57*a*, 57*b* will be formed as shown for FIG. 9, with the exception that there will be only one such protrusion 57*a*, 57*b* connected, respectively, in first and second board channel 106.

Figure 8:
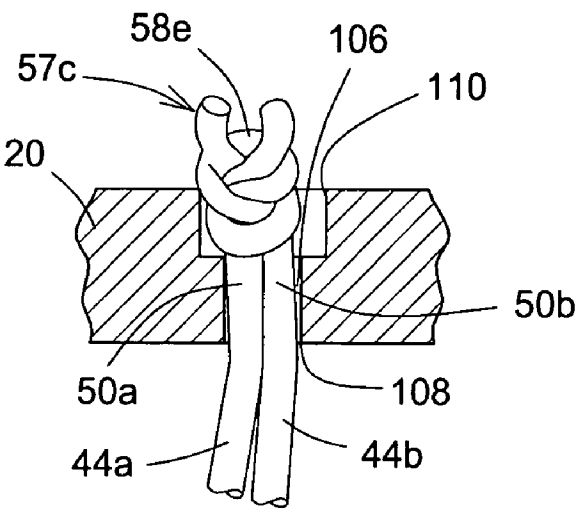
FIG. 8 is a sectional view similar to FIG. 7, showing two elastic cords tied into a combined connecting knot.

Referring now to FIG. 8, skateboard connecting means protrusions 57*a*, 57*b* may be replaced, or used in addition to, a combined third skateboard connecting means protrusion 57*c*. Combined third skateboard connecting means protrusion 57*c* is formed by tying first cord second end 50*a* and second cord second end 50*b* together to form fifth connecting knot 58*e* from both cords 44*a*, 44*b*. Combined third skateboard connecting means protrusion 57*c* may be removed by untying fifth connecting knot 58*e*. Skateboard connecting means protrusion 57*c* maintains elastic cords 44*a*, 44*b* connected to skateboard 12 In exactly the same fashion as first and second skateboard connecting means protrusions 57*a*, 57*b*.

Figure 7:
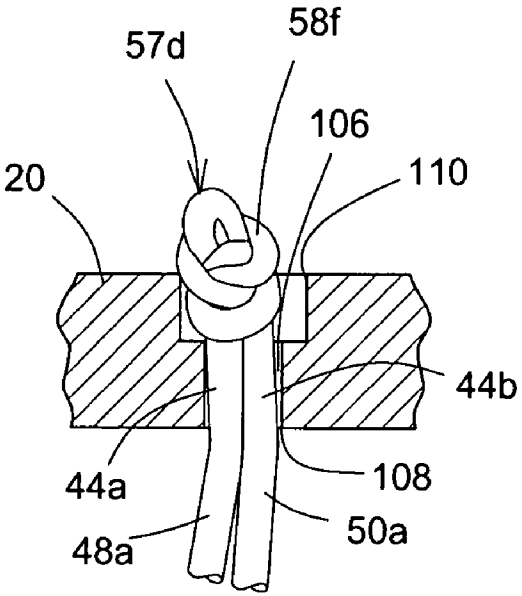
FIG. 7 is a sectional view taken along line 5-5 of FIG. 6 showing a single elastic cord.

In addition, one biasing member, i.e. first elastic cord 44*a*, is sufficient to provide biasing for first body end 32*a* and second body end 32*b*. For example, as shown in FIG. 7, first elastic cord member first end 48*a* could be connected to first body connecting means 45*a* and first elastic cord second end 50*a* could be connected to second body connecting means 46*b*. In such cases, first body connecting means protrusion 56*a* and second body means connecting protrusion 58*b* would be, respectively, first and second connecting knots 58*a*, 58*b*. Elastic cord 44*a* is connected to skateboard connecting means first board channel 106*a* at a position intermediate first elastic cord ends 48*a*, 50*a*. Specifically, elastic cord 44*a* could be so connected to first board channel 106*a* with an Intermediate fourth skateboard connecting means protrusion 57*d* formed by tying fifth connecting knot 58*f* intermediate the elastic cord ends 48*a*, 50*a*.

Figure 12:
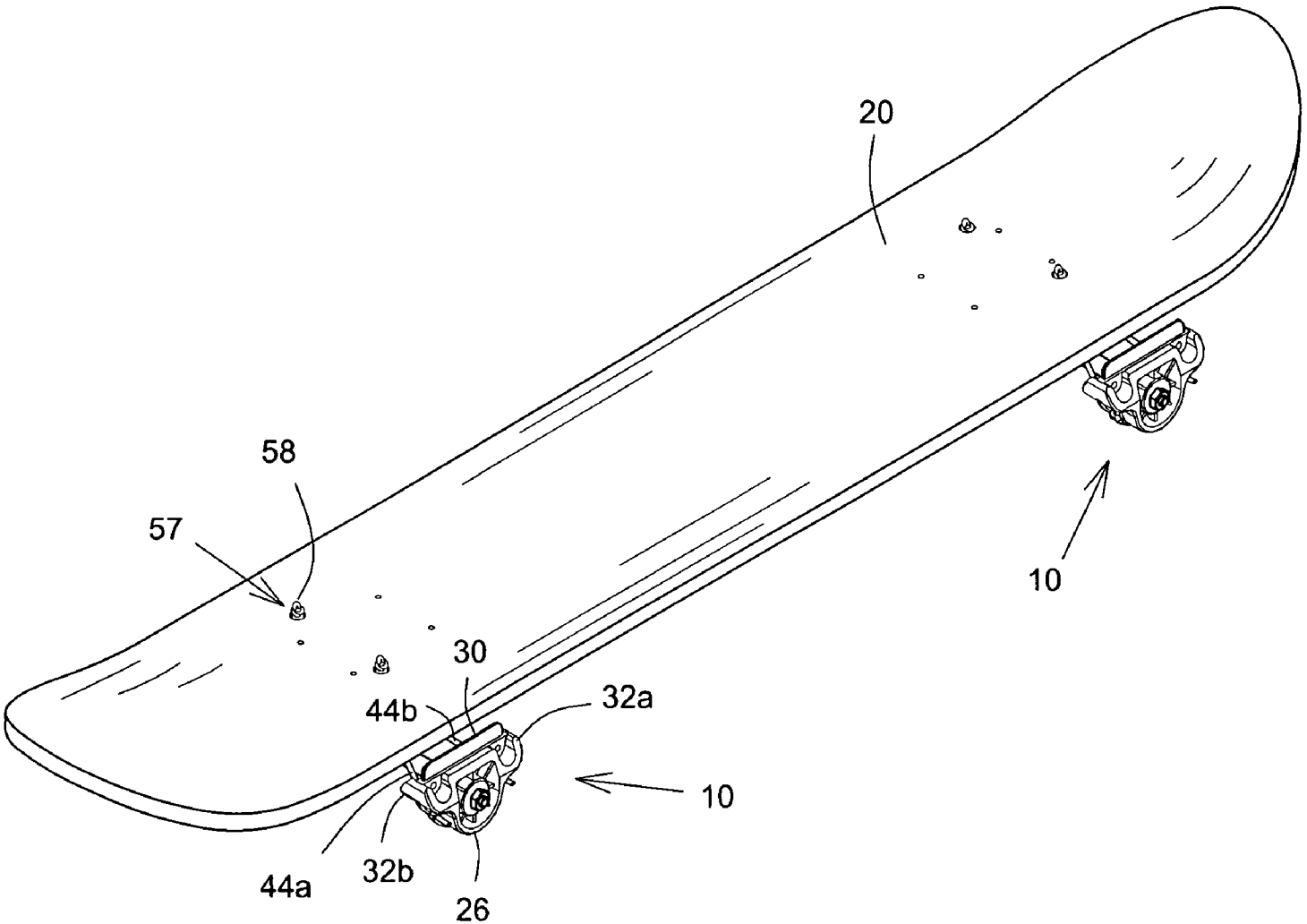
FIG. 12 is a top perspective view of the runner assembly of FIG. 1, mounted to a skateboard with biasing means connected to board channels of the skateboard and with blade of runner assembly facing skateboard.

Referring now to FIG. 12, biasing means 40, i.e. elastic cords 44, may be removed from body connecting means 46 and body 26 may be subsequently rotated such that blade 30 faces board bottom surface 18 prior to reconnecting biasing means 40 to body connecting means 46 in an inverse configuration. Specifically, instead of connecting body connecting means protrusion 56*a* to body connection means 46*a* and body connecting means protrusion 56*b* to body connection means 46*b*, body connecting means protrusions 56*b* is connected to body connection means 46*a* and body connecting means protrusions 56*a* is connected to body connection means 46*b*. Thus, biasing means 40 may hold body 26 in an inverted position, substantially inverted from neutral position 54, where blade 30 faces bottom board surface 18 for facilitating safe carriage and storage of skateboard 12 with runner assembly 10 connected thereto.

Figure 11:
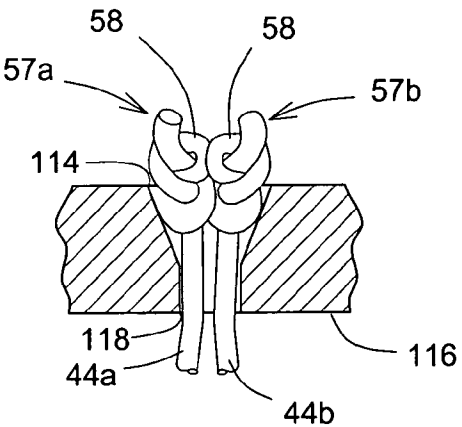
FIG. 11 is a sectional view taken along line 11-11 of FIG. 10.

Turning now to FIGS. 11, and 12, therein is shown runner 10 with biasing means 10 attached to truck assembly, instead of board 20. As shown, skateboard connecting means is a truck cavity 114 having at least one, i.e. a at least a first, truck skateboard connecting means opening 118 and using elastic cords 44*a*,44*b* as biasing means 40. In the embodiment, truck cavity 114 is disposed between lower truck surface 116 and bottom board surface 18 when truck assembly 16 is mounted to bottom board surface 18. When truck assembly 16 is so mounted, lower truck surface 116, having first truck skateboard connecting means opening 118 disposed therein, faces downwardly towards truck axle 14. Cord ends 50*a*, 50*b* are inserted through first truck skateboard connecting means opening 118 when truck assembly 16 is not mounted and connecting knots 58*b*, 58*d*, of greater dimension than lower truck opening 118 are formed in truck cavity 114 above lower truck surface 116 and first truck skateboard connecting means opening 118. As in the case where skateboard connecting means is board channel 106, second and fourth and connecting knots 58*b*, 58*d* are, respectively, first and second skateboard member connecting protrusions 57*a*, 57*c*. Trucking assembly 16 is then mounted to bottom board surface 18 and connecting knots 58*b*, 58*d* are thus held in truck cavity 114 until truck assembly 116 is unmounted and connecting knots 58*b*, 58*d*, are untied or otherwise removed.

Similarly to as shown in FIG. 8, when biasing means is body 20 is connected to truck, and first and second elastic cords 44*a*, 44*b* may also be formed into fifth combined connecting knot 58*e* for use as a combined third skateboard connecting means protrusion 57*c*. In addition, similarly to as shown in FIG. 7, one biasing member, i.e. first elastic cord 44*a* is sufficient to provide biasing for first body end 32*a* and second body end 32*b*, using connecting knot 58*f* as skateboard connecting means protrusion 57*d*. In such a situation, as previously described, first elastic cord member first end 48*a* would be connected to first body connecting means 46*a* and first elastic cord second end 50*a* could be connected to second body connecting means 46*b*. Truck cavity 114 may also have a second truck skateboard connecting means opening, identical to 118, on truck lower surface 116 which may act as a second skateboard connecting means. In such cases, first elastic cord 44*a* would be inserted through first truck skateboard connecting means opening 118 and second elastic cord 44*b* would be inserted through second truck skateboard connecting means opening 118, with skateboard connecting means protrusions 57*a*, 57*b* being respectively disposed upon first and second truck skateboard connecting means openings 118. Regardless of the means used for connecting biasing means 40 to skateboard 12, a user always has the choice to attach biasing means 40 to only first body end 32*a* or second body end 32*b*, although this would mean biasing could only be provided to body end 32 connected to biasing means 40. It will be apparent to one skilled in the art that other quantities and configurations of biasing members, such as elastic cords 44, for biasing means 40 and for skateboard connecting means, whether board channel 106 or truck cavity 114, are possible. It is not the intention of the inventor to restrict the quantity and configuration of biasing members for use in biasing means 40, such as elastic cords 44, or skateboard connecting means to those shown or described herein. In addition, it will further be apparent that biasing means 40 may be comprises of other materials than elastic cords 44. For example, bungee springs or heavy duty elastic bands could also be used. It is not the intention of the inventors to limit the biasing means 40 or the materials used to compose biasing means 40 to those described and shown herein.

It will be further apparent to one skilled in the art that connecting protrusions 56, 57 do not necessarily have to be comprised of connecting knots 58. For example, washers or the like could be used. It is not the intention of the inventors to limit connecting protrusions 56, 57 to those described and shown herein. It will be further apparent to one skilled in the art that lower truck opening 118 and board channels 106 may be combined to form skateboard connecting means. In addition body connecting means 46 may consist of other mechanisms, such as hooks. It is not the intention of the inventor to limit skateboard connecting means 106, 114 and body connecting means 46 to those shown and described herein.

Although the present blade runner for skateboard has been described with a certain degree of particularity, it is to be understood that the disclosure has been made by way of example only and that the present invention is not limited to the features of the embodiments described and illustrated herein, but includes all variations and modifications within the scope and spirit of the invention as hereinabove described.

I claim:

1. An ice skateboard runner assembly for housing a blade of an ice skateboard, the skateboard having a board with a top board surface and a bottom board surface and a truck assembly mounted on the bottom board surface, said runner assembly comprising:

an elongate body having generally opposed first and second longitudinal body ends, said body longitudinally housing the blade and being rotatably connectable to the truck assembly at a mounting position intermediate said first and said second body ends and being positionable in a runner neutral position in which the blade is substantially parallel to the board and faces generally away therefrom; and at least one elastic biasing cord releasably connecting the skateboard to said body ends, for elastically biasing said body toward said neutral position when one of said first body end and said second body end is moved away from the board;

wherein each body end has a respective open neck section extending proximally therefrom respectively into a respective body channel therefore defined by a respective through opening extending through said body proximal said body end and each biasing cord has a body connecting means protrusion situated on a first cord end thereof, said respective open neck and said biasing cord being configured for selectively and removably snappably inserting said biasing cord through said respective open neck into said respective body channel to releasaby connect said biasing cord to said body end, said body connecting means protrusion being sized and shaped to prevent passage thereof through said respective body channel.

2. The runner assembly of claim 1, further comprising at least one skateboard connecting means opening, disposed on said skateboard, said biasing cord being at least partially extendable through said skateboard connecting means opening for connecting said biasing cord to the skateboard.

3. The runner assembly of claim 2, wherein said biasing means cord further comprises at least one skateboard connecting means protrusion, said at least one skateboard connecting means opening being generally smaller than said at least one skateboard connecting means protrusion and through which said skateboard connecting means protrusion may not pass, said skateboard retaining means protrusion thereby preventing said biasing cord from being integrally withdrawn from said at least one skateboard connecting means opening.

4. The runner assembly of claim 3, wherein each body end comprises a generally convex semicircular respective runner surface, said respective first runner surface being substantially smooth for providing smooth sliding upon a sliding surface engageable thereby when said body end is moved away from the board.

5. The runner assembly of claim 4, wherein each respective runner surface extends transversely across a respective wall protruding outwardly from a respective inner surface extending transversely across said first body end, said respective wall being substantially centrally transversely inset on said body end, said respective wall and said respective inner surface defining a respective inlet section extending longitudinally inwardly from said respective runner surface and in which said biasing cord is at least partially engaged when said respective runner surface is sliding upon said sliding surface, thereby reducing exposure of said biasing cord to said sliding surface.

6. The runner assembly of claim 3, wherein said at least one body connecting means protrusion comprises a first body connecting means protrusion and a second body connecting means protrusion for connecting to said first and second body ends in said respective through apertures therefore.

7. The runner assembly of claim 3, further comprising a board channel extending from a bottom surface opening in the bottom board surface to said skateboard connecting means opening in the top board surface, said biasing cord being passed through said board channel and said at least one skateboard connecting means protrusion being subsequently formed on said biasing cord for preventing said biasing cord from being withdrawn through said board channel and said skateboard connecting means opening when connected to at least one of said first and second body ends until said at least one skateboard connecting means protrusion is removed.

8. The runner assembly of claim 3, further comprising a truck cavity disposed within said truck assembly, said truck cavity having said skateboard connecting means opening disposed on a bottom truck surface facing away from the bottom board surface, said biasing cord being introduced into said truck cavity through said skateboard connecting means opening, and said at least one skateboard connecting means protrusion being subsequently formed within said truck cavity for preventing said biasing cord from being withdrawn from said truck cavity through said skateboard connecting means opening when connected to at least first body connecting means until said at least one skateboard connecting means protrusion is removed.

9. The runner assembly of claim 1, wherein each respective open neck section comprises a respective first outer neck end and a generally opposed respective second outer neck end disposed on said respective first runner surface, said respective first outer neck end and said respective second outer neck end being curved inwardly away from said respective runner surface, thereby rendering said respective open neck section substantially smoothly aligned with said respective runner surface for facilitating sliding thereof upon said sliding surface.

10. The runner assembly of claim 5, wherein said respective through aperture is situated on said respective wall, with said respective body channel extending therethrough, said wall comprising an outwardly flaring respective section recess extending transversally outwardly from said respective through opening, said respective recess having smoothly indented guiding grooves, extending angularly away from opposing sides of said respective through opening, in which said biasing cord follows a rotating movement of said runner assembly on said truck assembly.

11. The runner assembly of claim 5, wherein each said body connecting means protrusion, when said biasing cord is connected to said respective body ends through said respective body channels, is substantially integrally seated in said inlet section to reduce protruding of said biasing cord and said body connecting means protrusion thereof beyond an outer face of said body which faces generally away from said truck assembly when said biasing cord is connected to said respective body end through said body channel, thereby impeding said biasing cord from becoming engaged upon a foreign object situated in proximity of said outer face.

12. The runner assembly of claim 1, wherein said respective runner surfaces are symmetrically shaped with respect to one another and smoothly aligned with one another, and said mounting position is substantially centered between said runner surfaces at substantially equal distances from said first body end and said second body end.

13. The runner assembly of claim 6, wherein said at least one biasing cord comprises a first biasing cord having a longitudinal first cord first end and a generally opposed longitudinal first cord second end and wherein said at least one skateboard connecting means protrusion comprises an intermediate connecting knot formed on an intermediary portion of said cord intermediate said first cord first end and said first cord second end.

14. The runner assembly of claim 6, wherein said at least one biasing cord comprises a first biasing cord having a longitudinal first cord first end and a generally opposed longitudinal first cord second end and wherein said first body connecting means protrusion comprises a first connecting knot formed on said first cord first end and said second body connecting means protrusion comprises a second connecting knot on said first cord second end.

15. The runner assembly of claim 6, wherein said at least one biasing cord comprises a first biasing cord having a longitudinal first cord first end and a generally opposed longitudinal first cord second end and a second biasing cord having a longitudinal second cord first end and a generally opposed longitudinal second cord second end.

16. The runner assembly of claim 15, wherein said at least one skateboard connecting means protrusion comprises a combined connecting knot formed from said first cord second end and said second cord second end.

17. The runner assembly of claim 15, wherein said first body connecting means protrusion comprises a first connecting knot formed on said first cord first end and said second body connecting means protrusion comprises a third connecting knot formed on said second cord first end.

18. The runner assembly of claim 15, wherein said at least one skateboard connecting means opening comprises a first skateboard connecting means opening and a second skateboard connecting means opening and wherein said at least one skateboard connecting means protrusion comprises a first skateboard connecting means protrusion removably selectively connectable to said first skateboard connecting means opening and a second skateboard connecting means protrusion selectively removably connectable to said second skateboard connecting means opening, said first skateboard connecting means protrusion comprising a second connecting knot formed on said first cord second end and said second skateboard connecting means protrusion comprising a fourth connecting knot formed on said second cord second end.

* * * * *